United States Patent [19]

Peterson

[11] 4,031,342

[45] June 21, 1977

[54] MATERIAL SENSING SWITCH

[76] Inventor: Reuben E. Peterson, 402 E. Washington Ave., Fergus Falls, Minn. 56537

[22] Filed: Feb. 11, 1976

[21] Appl. No.: 657,285

[52] U.S. Cl. ..... 200/61.21

[51] Int. Cl.[2] ..... H01H 35/00

[58] Field of Search ..... 200/61.2, 61.21, 61.04–61.07, 200/83 B, 83 N, 835, 835 A, 329–332, 85 R

[56] References Cited

UNITED STATES PATENTS

| | | | |
|---|---|---|---|
| 2,826,654 | 3/1958 | Conkling | 200/61.21 |
| 2,962,565 | 11/1960 | Schlicksupp | 200/61.21 |
| 3,018,343 | 1/1962 | Grostick | 200/61.21 |
| 3,121,145 | 2/1964 | Jeep, Jr. et al. | 200/83 B |
| 3,129,299 | 4/1964 | Bondkrich | 200/61.2 |
| 3,283,092 | 11/1966 | Grostick | 200/61.2 |
| 3,349,203 | 10/1967 | Wolford | 200/61.21 X |
| 3,396,694 | 8/1968 | Gruber | 200/61.21 X |
| 3,665,359 | 5/1972 | Alms | 200/61.21 X |

*Primary Examiner*—James R. Scott
*Attorney, Agent, or Firm*—Zarley, McKee, Thomte & Voorhees

[57] ABSTRACT

A material sensing switch comprising a hollow body having open opposite ends. A backing plate is removably secured to the body for closing one of the opposite ends. A flange extends outwardly from the body at the other of the opposite ends thereof for securing the body to a supporting member. A switch support plate is removably mounted in the body adjacent the other end thereof and has a central opening formed therein. A switch is secured to the switch support plate at the inner side thereof and has a movable switch arm extending outwardly through the central opening of the switch support plate. A pressure plate is removably secured to the body at the outer side of the switch support plate for activating the switch arm. A flexible member is removably secured to the body and covers the pressure plate and the other end of the body. A ring-shaped member secures the flexible member to the body. The apparatus is designed so that the backing plate may be removably secured to the other end of the body if desired and so that the switch support plate, pressure plate, flexible member and ring-shaped member may be secured to the one end of the body to enable the switch to be actuated from either end of the body depending upon the mounting of the same.

3 Claims, 6 Drawing Figures

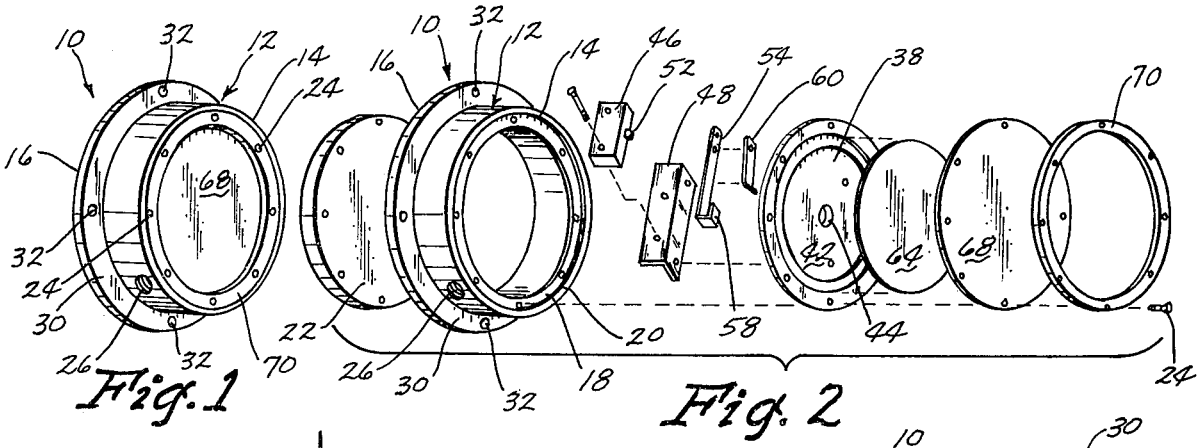
Fig. 1
Fig. 2
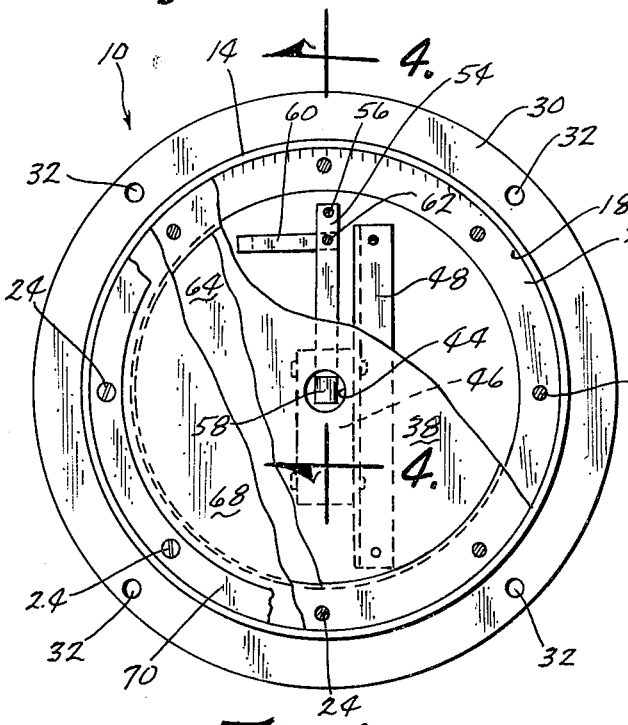
Fig. 3
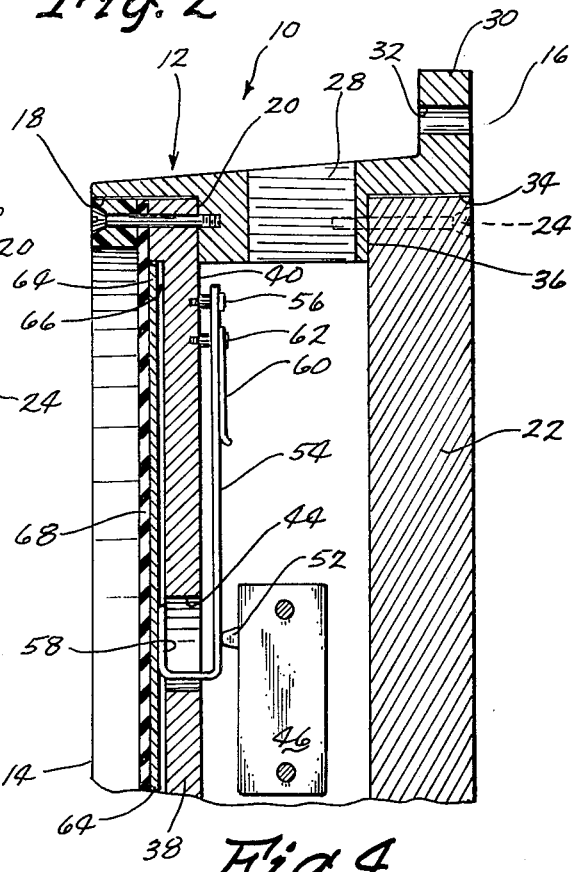
Fig. 4
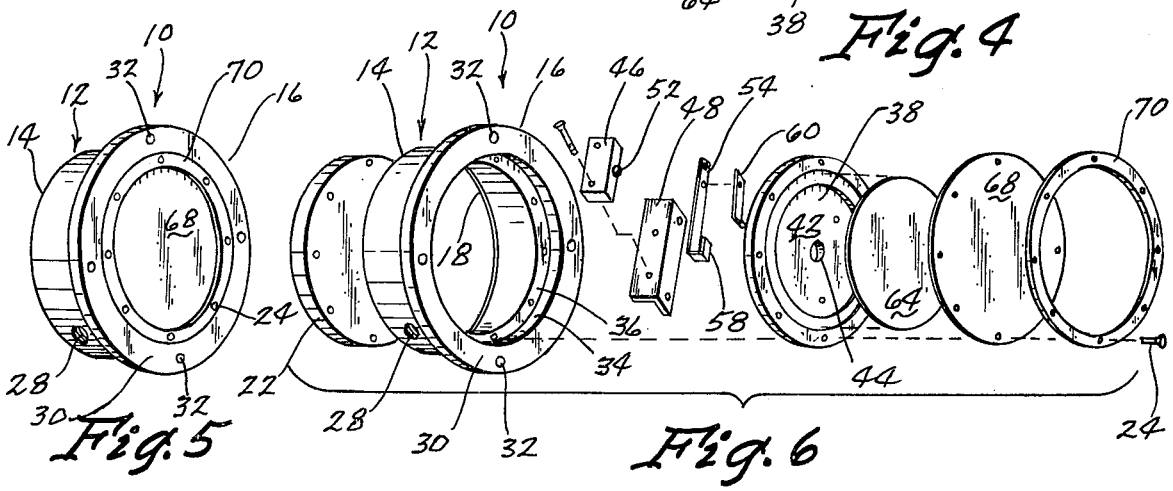
Fig. 5
Fig. 6

MATERIAL SENSING SWITCH

BACKGROUND OF THE INVENTION

This invention relates to a material sensing switch and more particularly to an improved material sensing switch which is ideally suited for use in dusty conditions such as bins, tanks, cement silos, etc.

Many material sensing switches have been previously provided but none have met with considerable success due to the environment in which they are normally used to sense material. Material sensing switches are commonly used in bins or the like to sense the presence or absence of material at a particular level within the bin. It is essential that a switch be provided which will function in dusty conditions and which will not create dangerous and hazardous sparks. It is also essential that the switches be comprised of a material which will not be damaged by the corrosive nature of the materials being sensed.

A further disadvantage in the prior art devices is that separate switches must be provided for inside bin mounts and outside bin mounts.

Therefore, it is a principle object of the invention to provide an improved material sensing switch.

A further object of the invention is to provide a material sensing switch which is durable in use.

A further object of the invention is to provide a material sensing switch which will not be damaged by the corrosive properties of the material being sensed.

A still further object of the invention is to provide a material sensing switch including means for adjusting the pressure required to activate the switch.

A still further object of the invention is to provide a material sensing switch which is reversible.

A still further object of the invention is to provide a material sensing switch which may have the components thereof reversed so that it may be used on an inside mount or an outside mount.

A still further object of the invention is to provide a material sensing switch which is economical to manufacture.

These and other objects will be apparent to those skilled in the art.

BRIEF DESCRIPTION OF THE DRAWINGS

FIG. 1 is a perspective view of the switch of this invention:

FIG. 2 is an exploded perspective view of the switch of this invention.

FIG. 3 is an end view of the switch:

FIG. 4 is a sectional view seen on lines 4—4 of FIG. 3:

FIG. 5 is a perspective view of the switch in a reversed position; and

FIG. 6 is an exploded perspective view illustrating the components of the switch being reversed.

DESCRIPTION OF THE PREFERRED EMBODIMENT

The material sensing switch of this invention is referred to generally by the reference numeral 10. Switch 10 includes a body 12 having ends 14 and 16. End 14 is provided with a recessed portion 18 formed therein defined by an annular shoulder 20 as seen in the drawings.

Body 12 includes a pair of threaded conduit receptacles 26 and 28 formed therein adapted to receive electrical connectors extending thereinto in conventional fashion. Body 12 is provided with an outwardly extending flange 30 at end 16 which has a plurality of openings 32 formed therein. End 16 of body 12 is provided with a recessed portion 34 defined by an annular shoulder 36. Recessed portion 34 is adapted to receive backing plate 22 and maintained therein by screws 24. Recessed portion 18 is adapted to receive switch support plate 38 having inner and outer surfaces 40 and 42 respectively. Plate 38 is provided with a central opening 44 formed therein.

The numeral 46 refers generally to a micro switch which is secured to inner surface 40 of support plate 38 by bracket 48. Switch 46 includes a switch plunger 52 extending therefrom which is adapted to either close or open the micro switch upon being moved relative to the switch depending upon whether the switch is normally closed or normally opened. Switch arm 54 is secured to switch support plate 38 at inner surface 40 by rivet 56 extending through one end thereof. The free end of switch arm 54 extends between the switch plunger 52 and plate 38 and has an arcuate portion 58 extending outwardly through the opening 44 in plate 38.

The numeral 60 refers to an adjustment arm which is selectively adjustably secured to plate 38 at the inner surface 40 thereof by means of screw 62 extending through arm 60 and through the switch arm 54 into plate 38. Selective rotatable movement of the adjustment arm 60 relative to the switch arm 54 permits pressure operation of the switch arm 54 to be varied. In other words, the more that adjustment arm 60 is parallel or is covering switch arm 54, the greater pressure will be needed to cause the switch arm 54 to move the switch plunger 52 relative to the micro switch 46.

Pressure plate 64 is received by the recessed portion 66 formed in outer surface 42 of plate 38. The number 68 refers to a flexible member comprised of a rubber-nylon material which is the same diameter as plate 38 and which extends over the pressure plate 64 and outer surface 42 of plate 38. Flexible member 68 is held in place by a ring 70 as illustrated in the drawings. Screws 72 extend through ring 70, flexible member 68, pressure plate 64 and into tapped openings formed in body 12 to maintain the components in position.

In operation, the switch 10 could be mounted in a storage bin or the like by means of bolts extending through openings 32 in flange 30 so that flexible member 68 would be engaged by the material within the bin. If switch 46 is normally open, pressure of the material against the flexible member 68 will cause pressure plate 64 to move arcuate portion 58 of switch arm 54 inwardly into engagement with switch plunger 52 so that the switch 46 will be closed thereby activating some form of signal device such as a light, buzzer, etc. which will indicate that the material in the bin or the like has reached the level of the switch 10. The rubber-nylon construction of flexible member 68 prevents the corrosive material being sensed from damaging the switch. The plastic ring 70 and its relationship to the flexible member 68 as well as the pressure plate 64 and support plate 38 insures that dust will not enter the interior of the switch.

An extremely important aspect of the switch of this invention is that is may be used for either inside bin mounts or outside bin mounts. The design of the components of the switch is such that backing plate 22 may be mounted in opening 18 with the switch support plate 38, pressure plate 64, flexible member 68 and ring 70 being mounted in opening 34 as illustrated in FIGS. 5 and 6 so that the flexible member 68 will be positioned at the opposite end (end 16) of the switch body to sense material. In other words, the components of the switch are reversible so that the switch may be used as an outside mount or as an inside mount.

Thus it can be seen that a unique switch has been provided which accomplishes at least all of the stated objectives.

I claim:

1. A material sensing switch assembly comprising, a hollow body means having open opposite ends, connection means for securing said body means to a support means, a substantially flat, circular backing plate means removably closing one of said opposite ends, a substantially flat, circular switch support plate means removably mounted in said body means adjacent the other of said opposite ends, said switch support plate having inner end outer sides, said switch support plate means having a centrally disposed opening formed therein, a switch means mounted at the inner side of said switch support plate means, switch actuator means comprising an elongated switch arm secured at one end to said inner side of said switch support plate means outwardly of the center thereof and extending towards said centrally disposed opening in a spaced relationship to said inner side, said switch arm having an end portion which extends through said centrally disposed opening and which has an actuator portion positioned outwardly of said outer face of said switch support plate means, a pressure plate means removably mounted adjacent the outer side of said switch support plate means for engagement with said actuator portion of said switch arm when said pressure plate means is moved towards said switch support plate means, said switch arm being positioned outwardly of said switch means and being adapted to actuate said switch means when said pressure plate means moves said actuator portion of said switch arm inwardly with respect to said switch support plate means, a flexible member operatively removably secured to said body means and covering said pressure plate means for sealing said other end of said body means, and means securing said flexible member to said body means.

2. The switch apparatus of claim 1 wherein an adjustment arm is selectively rotatably mounted on the inner side of said switch arm adjacent the said one end thereof, said adjustment arm being selectively movable from a first non-engaging position with respect to said switch arm to a second parallel and engaging position with respect to said switch arm whereby selective rotatable movement of said adjustment arm relative to said switch arm permitting pressure operation of said switch arm to be varied.

3. The switch apparatus of claim 1 wherein said switch support plate means, said pressure plate means, said flexible member and said means securing said flexible member to said body means may be selectively reversibly mounted at said one end of said body means with said backing plate means removably closing the other end of said body means to enable the switch means to be activated from said one end of said body means when the aforesaid components are so reversibly positioned.

* * * * *